United States Patent [19]

Carlsson

[11] 4,401,250

[45] Aug. 30, 1983

[54] METHOD AND AN ARRANGEMENT FOR THE FORWARD FEEDING OF A MATERIAL WEB IN REGISTER WITH A CREASE LINE PATTERN

[75] Inventor: Lars Carlsson, Blentarp, Sweden

[73] Assignee: Tetra Pak International AB, Lund, Sweden

[21] Appl. No.: 345,373

[22] Filed: Feb. 3, 1982

[30] Foreign Application Priority Data

Feb. 25, 1981 [SE] Sweden ..... 8101229

[51] Int. Cl.[3] ..... B65H 23/18; B65H 17/22

[52] U.S. Cl. ..... 226/33; 226/35; 226/154

[58] Field of Search ..... 226/27-35, 226/120, 152-155; 156/361, 364

[56] References Cited

U.S. PATENT DOCUMENTS

| | | | |
|---|---|---|---|
| 3,204,842 | 9/1965 | Reimann | 226/27 |
| 3,640,439 | 2/1972 | Selke | 226/32 |
| 4,008,839 | 2/1977 | Yamashita | 226/32 |
| 4,153,190 | 5/1979 | Marion | 226/33 |
| 4,217,163 | 8/1980 | Utzmann et al. | 156/361 |

*Primary Examiner*—Leonard D. Christian
*Attorney, Agent, or Firm*—Burns, Doane, Swecker & Mathis

[57] ABSTRACT

In the intermittent forward feeding of a material web provided with transverse crease lines and simultaneous punching of holes into the material web in a definite relation to the crease line pattern, it is important to ensure that any faults in the length of the forward feed, do not accumulate during working over longer periods. Such faults, which occur due to unavoidable inaccuracies would lead successively to ever increasing faultiness in the placing of the holes. A method and an arrangement adapted to avoid the accumulation of such faults are provided.

In the method the material web during each forward feeding is advanced a distance which exceeds the correct distance between two transverse lines by the fault margin. Subsequently, before the next forward feeding, the web is restored to a correct position, not affected by any faults in the distance between the crease lines.

An arrangement for the carrying out of the method has, beside a driving element in the form of a driven roller situated in contact with the material web, also a register-holding element. The register holding element includes drivers, which engage with the transverse crease lines, and which after each forward feeding, with simultaneous disengagement of the driving element, restores the web a certain distance so as to place the crease lines into the correct position.

12 Claims, 5 Drawing Figures

METHOD AND AN ARRANGEMENT FOR THE FORWARD FEEDING OF A MATERIAL WEB IN REGISTER WITH A CREASE LINE PATTERN

BACKGROUND AND SUMMARY OF THE PRESENT INVENTION

The present invention relates generally to a method and an apparatus for feeding a material web. More specifically, the present invention relates to a method for the intermittent forward feeding of a material web, provided with transverse weakening lines, in register with the weakening lines. The present invention also relates to an arrangement for the intermittent forward feeding of a material web provided with transverse weakening lines.

In the manufacture of weblike packing material of the type which subsequently is converted into packing containers, it happens frequently that some form of processing, e.g. punching of emptying holes in the web, is to be carried out. When the material web is provided with weakening lines in the form of crease lines in a certain pattern (so as to facilitate the folding when the material is converted into packing containers) the processing has to be done in register with the crease line pattern. In other words, the emptying holes must be placed in an accurate relation to the crease line pattern. This is done by intermittent feeding of the material web past the processing tool (e.g. a hole punch). It has been found to be difficult to ensure that the web is punched each time with the crease line pattern in exactly the correct position in relation to the punching tool, since the distance between the crease lines, for natural reasons, does not exactly coincide with the length of the forward feed. Hence manual correction of the length of the forward feed becomes necessary after a certain number of forward feeds, which renders the manufacture more complicated and more expensive without providing in return the desired uniform placing of the holes.

It is known that the length of forward feed can be corrected and controlled continuously during the forward feeding with the help of a photocell which reads the length of forward feed with the help of markings, so-called photocell marks. These may be present on the web, which may consist of limited squares in contrasting colors which have been applied by printing onto the web in register with the crease line pattern. However, this system makes necessary an expensive and complicated electronic arrangement which in practice has been found not to function with the required safety. The method in many cases fails to give sufficient accuracy, since it wholly depends on the accuracy with which the photocell marks have been applied in relation to the crease line pattern.

In it an object of the present invention to provide a method and an arrangement of the type described in the introduction which are not subject to the abovementioned disadvantages.

It is a further object of the present invention to provide a method and an arrangement which work according to a simple principle and with simple mechanical components and which consequently are of high accuracy and safety in operation.

It is a further object of the present invention to provide a method and an arrangement which accept certain unavoidable faults in the distance between the crease lines and which continuously compensate for these faults so that they are not accumulated during working over long periods.

These and other objects have been achieved in accordance with the invention in that a method for the intermittent forward feeding of a material web, provided with transverse weakening lines, in register with the weakening lines the web being fed forward by a driving element over a distance which exceeds the desired length of forward feed by a defined partial distance. Thereupon the driving element is disengaged and a register-holding element, through engagement with a weakening line, restores a part of the web situated between the register-holding element and the driving element, until the weakening line has been brought into a desired position at a predetermined distance from the driving element.

An arrangement for the intermittent forward feeding of a material web provided with transverse weakening lines has a driving element capable of being disengaged and register-holding element located in front of the driving element seen in the direction of feeding of the web. The register holding element is provided with drivers co-operating with the weakening lines of the web and is adapted so that through engagement with a weakening line it moves the same to a repeatable position at a certain distance from the driving element.

Preferred embodiments of the method as well as the arrangement in accordance with the invention have been given moreover the characteristics which are evident from the description below.

BRIEF DESCRIPTION OF THE DRAWING

A preferred embodiment of the method and arrangement in accordance with the invention will now be described in more detail with special reference to the enclosed schematic drawings which only illustrate the details required for an understanding of the invention.

DETAILED DESCRIPTION OF THE PREFERRED EMBODIMENT

Figure 1:
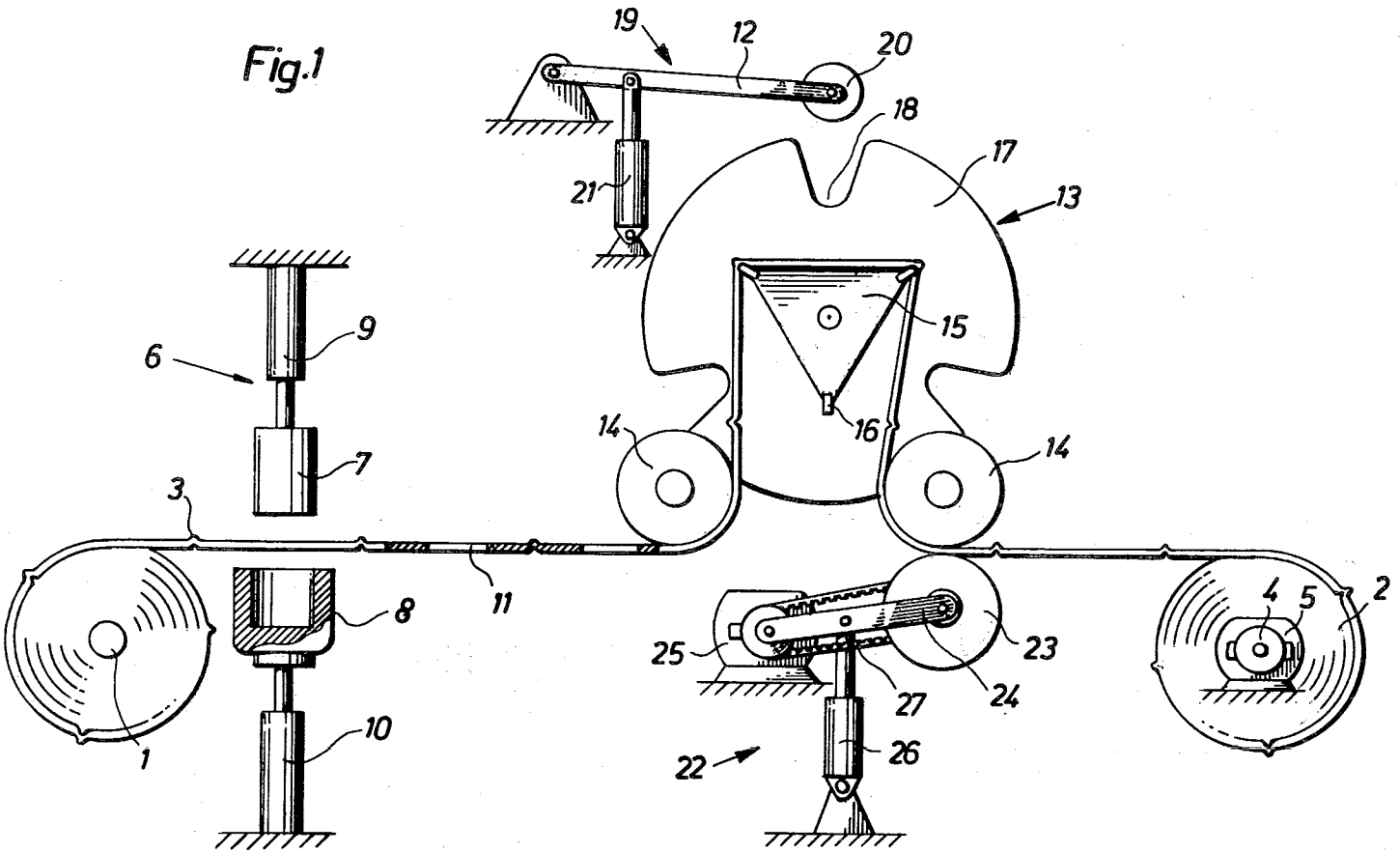
FIG. 1 is a schematic side elevational view, partly in section of an arrangement in accordance with the invention.

It will be seen from FIG. 1 how a preferred embodiment of the arrangement in accordance with the invention processes a packing material web which is rolled off a first cylinder 1, shown on the left in the figure, to be rolled up again after processing to a roll 2. The material web is of the type which is frequently used in the manufacture of e.g. packing containers for milk and includes a central carrier layer of paper which is coated on either side with homogeneous liquid-tight plastic layers. The laminate web has been provided during manufacture with a printed decorative pattern as well as with a crease line pattern including, inter alia, crease lines 3 extending transversely across the web and placed at regular intervals. For the sake of clarity, these are the only crease lines indicated in the figure. The crease lines are of the conventional type, that is to say they are produced by upsetting or pressing of the material, so that the one side of the material shows a ridge while the other side of the material shows a recess.

The material web, not yet processed by the arrangement in accordance with the invention, is stored, as mentioned previously, in rolled-up form on a cylinder 1 which is provided with some form of brake, so as to ensure that the web is maintained stretched during the feeding through the arrangement in accordance with the invention. The processed material is wound up on a cylinder, not shown, to form the roll 2 of finished material. The winding up is ensured by a motor which is connected via a sliding clutch with the cylinder, not shown, of the roll 2 and drives the same in clockwise direction with such power that the part of the web passing through the machine is maintained stretched.

Immediately after the packing material web has been rolled off the cylinder 1, the web is passed through a punching unit 6 which has a punch 7 arranged above the web and a co-operating die 8 arranged underneath the web. The punch 7 as well as the die 8 are maneuverable towards a meeting point in the plane of the web by a pneumatic piston and cylinder unit 9 and 10 respectively, both these units being firmly attached to the frame of the machine.

After the punching of the emptying holes 11 into the material web, the latter passes over a guide roller 14, a register-holding element 13 and a further guide roller 14 before it reaches the winding-up roll 2. The guide rollers 14 are both freely rotating and serve for the guiding of the web so, that it extends around and partly surrounds the part of the register-holding element 13 which co-operates with the material web.

The part of the register-holding element 13 co-operating with the material web includes a central body 15 which is of substantially triangular cross-section and which is provided on each of its three mutually parallel edges with drivers 16 in the form of rules which are partly embedded in grooves in the central body 15. The distance between the projecting active edges of the rules corresponds substantially to or is slightly less than the distance between two crease lines 3 on the material web. Because of this, the transverse crease lines of the material web can during the rotation of the register-holding element locate by themselves, thanks to the stiffness of the packing material in, the correct position in relation to the active edges. Practical experiments have shown that the distance between the active edges of the rules should be somewhat smaller than the smallest conceivable distance (smallest accepted distance for approved material) between two consecutive crease lines and preferably amount to approx. 99.5% of the said distance.

The central body 15 is rigidly connected to a flange or disc 17 which together with the central body is suspended so that it is freely rotatable in the machine frame. The disc 17 is provided with three peripheral, substantially V-shaped recesses 18 which are arranged at a regular pitch around the disc are and situated at an identical angular distance from the respective drivers 16. A locking arrangement 19 is provided to co-operate with the recesses 18 and is arranged at some distance outside the periphery of the disc 17. The locking arrangement 19 includes a pivoting lever 12 which is supported at one end in the machine frame, and which at its other end carries a freely rotating locking and driving pulley 20. Between the fixed point and the driving pulley, the lever 12 is connected to a piston and cylinder unit 21 which can maneuver the lever between two positions. These are an inactive position, wherein the locking and driving pulley 20 is wholly outside the periphery of the disc 17 (this position is shown in FIG. 1) and an active position, wherein the locking and driving pulley 20 is lowered into one of the recesses 18 and rests against the bottom of the same. The bottom radius of the recess 18 preferably corresponds to the radius of the pulley 20. Owing to the substantially V-shape of the recess 18, the driving pulley 20, when it is moved down into a recess 18, will turn the register-holding element to the correct position in which the driving pulley rests against the bottom of the recess 18 and prevents further rotation of the register-holding element.

The forward driving of the web through the machine takes place by a driving element 22 which is arranged underneath the register-holding element 13 (and behind the same seen in the direction of feeding). The driving element 22 includes a driving roller 23 which rests against the processed web part and the guiding roller 14 acting as a counter-roller. The driving roller 23 is supported by a lever 24 which at its opposite end is adapted so that it can pivot about a driving axle of a forward feed driving motor 25. The lever 24 can be maneuvered a pneumatic piston and cylinder unit 26 between an active position, shown in FIG. 1, wherein the driving roller 23 rests against the material web, and an inactive position, wherein the driving roller 23 is at a distance from the material web. The driving roller 23, which is suspended so that it can freely rotate at the front end of the lever 24, is driven via a toothed belt 27 which extends about the driving axle of the driving motor 25.

The method in accordance with the invention as well as the function of the arrangement will now be described in more detail with special reference to FIG. 2, which in four steps shows schematically four different stages during the intermittent forward feeding of the material web in register with the weakening or crease line pattern formed on the web. As mentioned earlier, the method and the arrangement in accordance with the invention aim at making it possible to perform during intermittent forward feeding of a pre-creased material web a repeated processing such as e.g., hole-punching, in an accurately fixed position in relation to the crease line pattern. In this type of intermittent feeding and repeated processing it is not possible to make the length of forward feed coincide exactly with the distance between consecutive crease lines, since the distance between these may vary within certain tolerance limits, which determine whether a material batch is to be accepted or rejected. It is thus not possible completely to avoid certain faults in the length of forward feed and it is thus of major importance that the method and arrangement are designed so that these faults do not accumulate during prolonged processing runs. This can be prevented by a correction of the length of forward feed during each feeding, which, as mentioned previously, may be achieved e.g. with the help of photocells and photocell marks pre-printed onto the web. However, the present invention teaches an appreciably less complicated and more reliable method wherein after a certain excess forward feeding, a part of the web fed forward is mechanically restored to a correct position ready for the next feed.

In FIG. 2 is shown schematically the path of the material web between the punching unit 6, the register-holding element 13 and the driving roller 23. The two guide rollers 14 are also indicated in the figures. The transverse crease lines on the material web, which determine the location of the punched holes, are indicated by short diversions across the web. Finally, the movements of the different parts of the material and of the various devices are also shown by arrows.

Figure 2A:
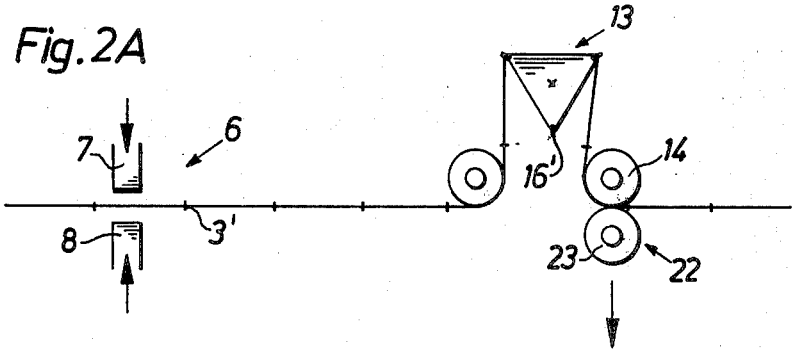
FIGS. 2A—2D are four schematic side elevational views which show in steps the method in accordance with the invention, as carried out with the arrangement shown in FIG. 1.

In FIG. 2A the forward feeding of the material web has just been completed and the material web is in correct position for punching by the punch unit 6 in the desired position at the predetermined distance from the adjoining crease line 3'. The forward driving by the driving element 22 has been interrupted and the driving roller 23 has been moved out of engagement with the material web and the guide roller 14. The register-holding element 13 is disengaged, that is to say the locking and driving pulley 20 (FIG. 1) is outside the periphery of the disc 17.

Figure 2B:
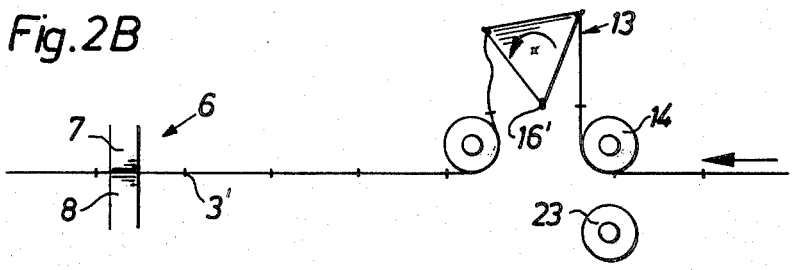

In FIG. 2B the two punching components 7, 8 of the punch unit have met and punched through the material web. As a result the rear part of the material web, that is to say the part of the material web which in the figures is situated to the left of the register-holding element 13, is also being held fast. At the same time as the punching is carried out, a correction now takes place of the length of forward feed before the subsequent intermittent forward feeding. In the correction the forward part of the web, situated to the right of the register-holding element 13, is moved so that a crease line is placed at a distance accurately defined in advance from the line of engagement between the joint center plane of the driving roller 23 and guide roller 14. This is achieved in that the regiser-holding element 13, by the locking device 19 and the driving pulley 20 (see FIG. 1) is moved to one of its three defined positions. Thus a forward upper one of the 16' drivers of the register-holding element 13 engages with a crease or weakening line 3 and restores the front part of the web situated between the register-holding element and the driving element until the crease line has been brought into the desired position at the predetermined distance from the driving element 22. The driving of the register-holding element 13 creates a certain surplus of material at the rear (left) side of the register-holding element and as a consequence, the tension in the part of the material web which is between the register-holding element 13 and the guide roller 12 subsides. However, this does not affect the part of the web which is situated at the punch unit 6, since the engagement between the web and the punches continues to be maintained.

Figure 2C:
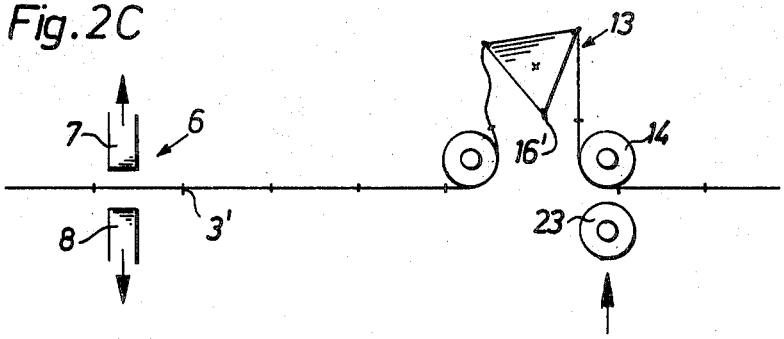

Through the restoring of the front end of the material web and the placing of the selected crease line at a known distance from the plane of engagement between the driving roller 23 and the guide roller 14, a continued feeding in register is assured irrespectively of earlier faults which may have been caused e.g. by an incorrect length of forward feed, faultily placed crease lines or outside interferences. The driving roller 23 can now be placed in contact again with the material web and the guide roller 14, at the same time as the punch unit 6, after a completed punching operation, releases the rear part of the material web. The locking device 19 moves the driving pulley 20 again out of engagement with the recess 18 of the register-holding element 13 (see FIG. 1), so that the central body of the register-holding element becomes freely rotatable and can be driven by the web on the continued forward feeding of the same (FIG. 2C).

Figure 2D:
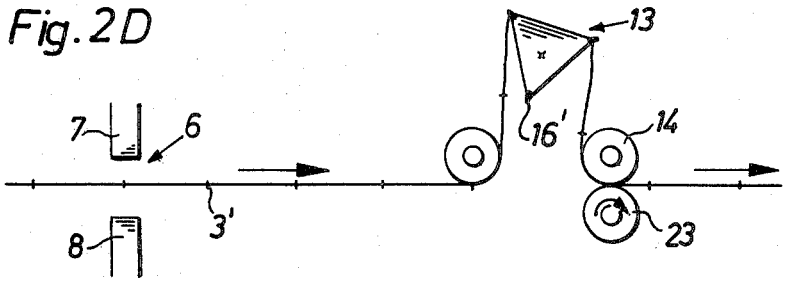

In FIG. 2D the driving roller 23 has been brought into engagement again with the material web and now drives the material web forward over a predetermined distance. This predetermined distance is equal to the correct distance between crease lines of the web and a partial distance which corresponds to the maximum occuring so called "plus" or positive tolerance in the distance between crease lines. This maximum possible positive tolerance is known and defined after the manufacture of the packing material web, and the length of forward feed consequently can be set in advance for each continuous material web. The partial distance by which the length of forward feed exceeds the correct distance between two consecutive transverse crease lines has the effect that the surplus of material which has been formed on restoring of the web by the register-holding element 13 is eliminated. During forward feeding of the material web the register-holding element rotates freely and is driven owing to the engagement with the transverse crease lines of the material web. Because of the surplus feeding, the register-holding element 13 will be situated, at the end of the forward feeding, once more in the position shown in FIG. 2A, whereupon the cycle described earlier with the restoring of the front part of the web is repeated again.

Because the restoring of the web places a crease line in a correct position situated at an accurately defined distance from the driving roller, each forward feeding will advance the web from an exact starting position over an exact, predetermined distance. This ensures that the punching operation can take place the whole time at a correct place in relation to the crease line pattern, without any faults accumulating therein and causing a successive displacement of the punching position during longer, continuous runs.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

What is claimed is:

1. A method for selectively advancing a material web, comprising:

feeding the web forward by driving means over a distance which exceeds a desired length of forward feed by a predetermined length;

contacting one of a plurality of transverse weakening lines of the web with register holding means; and repositioning a portion of the web located between said driving means and said register holding means, said repositioning being used to locate said one weakening line at a desired distance from said driving means.

2. The method of claim 1 wherein the web during the forward feeding engages with and drives the register-holding means.

3. A method for selectively advancing a material web, provided with transverse weakening lines, in register with the weakening lines, comprising:

feeding the web forward by driving means over a distance which exceeds a desired length of forward feed by a predetermined length;

disengaging said driving means;

contacting a weakening line of the web with register holding means; and repositioning a portion of the web by rotating said register holding means, said portion of the web being located between said driving means and said register holding means, said portion of the web being moved rearwardly until said weakening line is situated at a selected distance from said driving means.

4. The method of claim 1 or 3, wherein the desired length of forward feed is equal to the correct distance between weakening lines of the packing material web, the predetermined length by which the forward feeding exceeds the desired length of forward feed corresponding to a maximum positive tolerance occurring in the distance between the weakening lines.

5. The method of claim 4 further comprising the step of:

holding a portion of the material web while cutting an aperture in the material web, said step of holding occurring simultaneously with said step of contacting a weakening line of the web with register holding means.

6. An arrangement for the intermittent forward feeding of a material web having transverse weakening lines, comprising:

driving means for selectively advancing the material web; and register holding means for positioning a portion of the web located between said driving means and said register holding means, at least one driver element located on said register holding means cooperating with one of the weakening lines of the web to position said one weakening line a predetermined distance from said driving means.

7. The arrangement of claim 6 wherein said register holding means comprises a rotatable body having a plurality of parallel edges with each edge serving as one of said driver elements, and wherein said body is adapted so that it can be fixed in defined positions by a locking device.

8. The arrangement of claim 7, wherein the register-holding means further comprises a disc, rigidly connected with the rotatable body which disc has a number of peripheral recesses corresponding to the number of drivers to co-operate with the locking device.

9. The arrangement of claim 8, wherein the recesses are V-shaped.

10. The arrangement of claim 7 wherein the register-holding element has three drivers which are arranged at regular pitch around the periphery of the rotatable body, the distance between the drivers substantially corresponding to the distance between two consecutive weakening lines on the material web.

11. An arrangement for the intermittent forward feeding of a material web having transverse weakening lines, comprising:

a rotatable triangular body having a driving element at each corner, at least one of said driving elements cooperating with a weakening line of the web;

a disc rigidly attached to said body and provided with three peripheral recesses, each recess being situated at an identical angular distance from a respective one of said driving elements;

locking means cooperating with a respective one said recesses for locking of said body in a selected position; and a selectively disengageable driving roller which, when advancing the web, cooperates with a guiding roller.

12. The arrangement of claim 11 wherein said peripheral recesses of said disc are each substantially V-shaped and wherein said locking means includes a positioning roller which is lowered into one of said recesses, when said driving roller is disengaged, thereby rotating said body to a position in which said positioning roller rests against the bottom of said one recess whereby a portion of the web, located between said rotatable body and said guiding roller, is positioned as desired.

* * * * *